US008934800B2

(12) United States Patent
Matayoshi

(10) Patent No.: US 8,934,800 B2
(45) Date of Patent: Jan. 13, 2015

(54) TRANSFER DEVICE AND IMAGE FORMING APPARATUS PROVIDED WITH SAME

(71) Applicant: KYOCERA Document Solutions Inc., Osaka-shi, Osaka (JP)

(72) Inventor: Akira Matayoshi, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/067,022

(22) Filed: Oct. 30, 2013

(65) Prior Publication Data

US 2014/0119761 A1 May 1, 2014

(30) Foreign Application Priority Data

Oct. 31, 2012 (JP) ..... 2012-240150

(51) Int. Cl.
*G03G 15/16* (2006.01)

(52) U.S. Cl.
CPC .... *G03G 15/1675* (2013.01); *G03G 2215/0132* (2013.01)
USPC ..... 399/66

(58) Field of Classification Search
USPC ..... 399/66
See application file for complete search history.

(56) References Cited

U.S. PATENT DOCUMENTS

| | | | | |
|---|---|---|---|---|
| 7,596,331 | B2 * | 9/2009 | Kinokuni | 399/66 X |
| 7,877,032 | B2 * | 1/2011 | Takeuchi | 399/66 |
| 2011/0069979 | A1 | 3/2011 | Yamada | |

FOREIGN PATENT DOCUMENTS

| | | |
|---|---|---|
| JP | 63-286878 | 11/1988 |
| JP | 2000-137366 | 5/2000 |
| JP | 2011-65024 | 3/2011 |

OTHER PUBLICATIONS

Office Action Issued in Japanese Patent Application No. 2012-240150—Oct. 21, 2014.

* cited by examiner

*Primary Examiner* — Sandra Brase
(74) *Attorney, Agent, or Firm* — Gerald E. Hespos; Michael J. Porco; Matthew T. Hespos

(57) ABSTRACT

A transfer device includes image bearing members, an intermediate transfer belt, transfer members, a transfer bias applying unit and a bias control unit. The transfer bias applying unit applies a transfer bias to the transfer. The bias control unit causes a transfer bias having a polarity opposite to that of the toner to be applied to a first transfer member during the transfer process in the first transfer nip and during an adjacent transfer process which is the non-transfer process in the first transfer nip and the transfer process in a second transfer nip adjacent to the first transfer nip. Further, the bias control unit causes a transfer bias having the same polarity as that of the toner to be applied to the first transfer member during an adjacent non-transfer process which is the non-transfer process in the first transfer nip and the non-transfer process in the second transfer nip.

15 Claims, 8 Drawing Sheets

〈14A〉

TRANSFER DEVICE AND IMAGE FORMING APPARATUS PROVIDED WITH SAME

This application is based on Japanese Patent Application Serial No. 2012-240150 filed with the Japan Patent Office on Oct. 31, 2012, the contents of which are hereby incorporated by reference.

BACKGROUND

The present disclosure relates to a transfer device provided with an intermediate transfer belt for bearing a toner image and an image forming apparatus provided with the same.

An electrophotographic image forming apparatus is known which is provided with a photoconductive drum for bearing an electrostatic latent image and a transfer device for transferring a toner image from the photoconductive drum to a sheet. To transfer a multi-color image to a sheet, the transfer device is provided with the intermediate transfer belt, primary transfer members and a secondary transfer member. The intermediate transfer belt is rotated in such a manner as to face a plurality of photoconductive drums and toner images are transferred onto the intermediate transfer belt from the respective photoconductive drums by primary transfer voltages applied to the primary transfer members. The toner images are collectively transferred from the intermediate transfer belt to the sheet by a secondary transfer voltage applied to the secondary transfer member.

There is also known a technique provided with a detector for detecting a resistance value of an intermediate transfer belt and adapted to heat and cool the intermediate transfer belt. There is further known a technique provided with a system in which a primary transfer voltage is constant-current controlled and adapted to reduce a primary transfer current value according to a resistance value of an intermediate transfer belt.

SUMMARY

A transfer device according to one aspect of the present disclosure includes a plurality of image bearing members, an intermediate transfer belt, a plurality of transfer members, a transfer bias applying unit and a bias control unit. Each image bearing member is driven and rotated and bears a toner image made of toner which is charged to a predetermined polarity. The intermediate transfer belt is arranged to face the plurality of image bearing members and driven and rotated to transfer the toner images from the plurality of image bearing members to a surface thereof in a superimposed manner. The transfer members form a plurality of transfer nips in cooperation with the plurality of image bearing members by sandwiching the intermediate transfer belt and cause the toner images to be transferred from the image bearing members to the intermediate transfer belt. The transfer bias applying unit applies a transfer bias to the transfer member during a transfer process in which the toner image is transferred from the image bearing member to the intermediate transfer belt and a non-transfer process different from the transfer process. The bias control unit causes a transfer bias having a polarity opposite to that of the toner to be applied to a first transfer member, out of the plurality of transfer members, configured to form a first transfer nip out of the plurality of transfer nips during the transfer process in the first transfer nip and during an adjacent transfer process which is the non-transfer process in the first transfer nip and the transfer process in a second transfer nip adjacent to the first transfer nip. Further, the bias control unit causes a transfer bias having the same polarity as that of the toner to be applied to the first transfer member during an adjacent non-transfer process which is the non-transfer process in the first transfer nip and the non-transfer process in the second transfer nip.

Further, an image forming apparatus according to another aspect of the present disclosure includes the above transfer device and a sheet transfer member. The sheet transfer member transfers a toner image from the intermediate transfer belt to a sheet.

These and other objects, features and advantages of the present disclosure will become more apparent upon reading the following detailed description along with the accompanying drawings.

DETAILED DESCRIPTION

Hereinafter, an image forming apparatus 10 according to an embodiment of the present disclosure is described in detail based on the drawings. In this embodiment, a tandem type color printer is illustrated as an example of the image forming apparatus. The image forming apparatus may be, for example, a copier, a facsimile machine or a complex machine provided with these functions.

Figure 1:
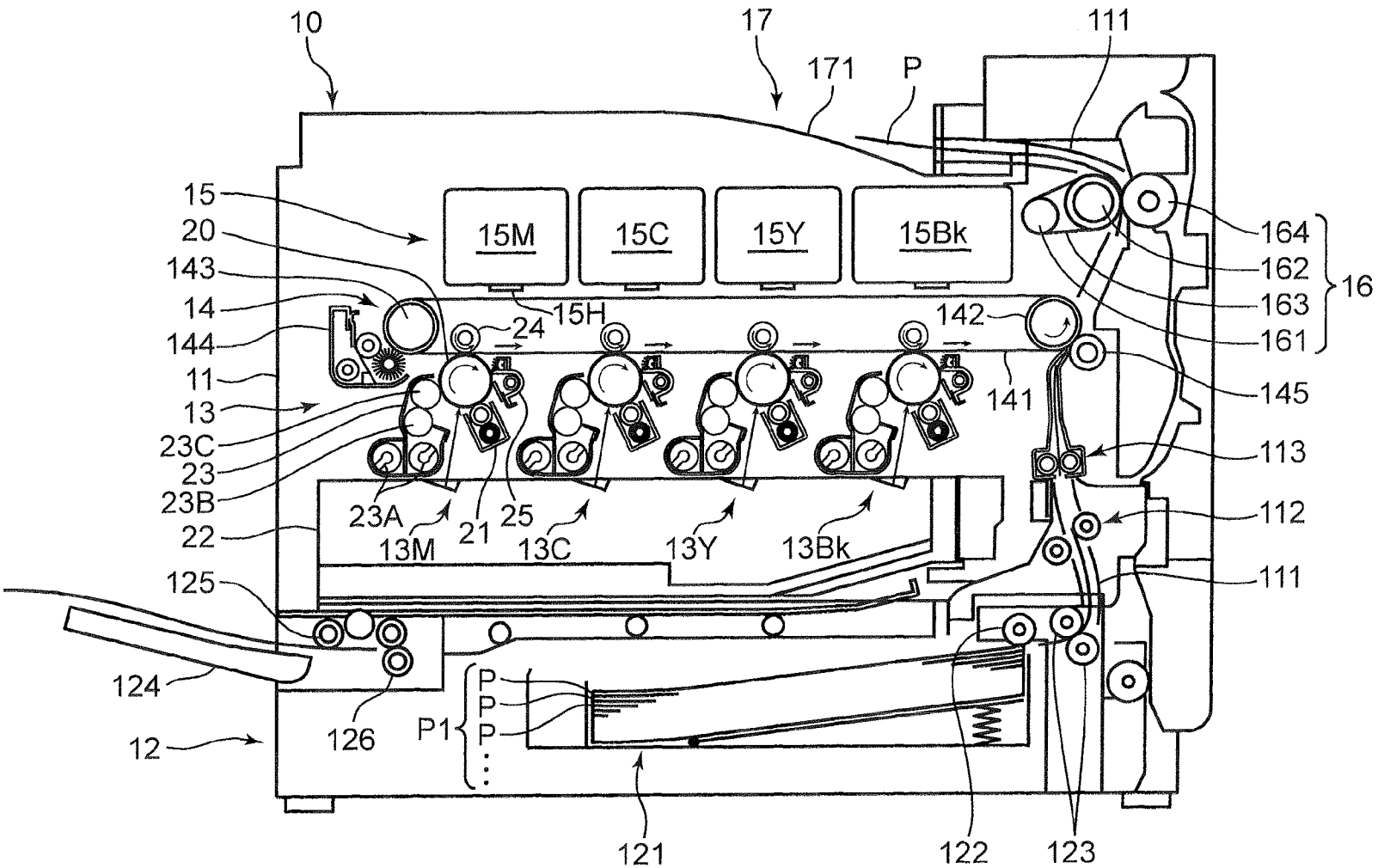
FIG. 1 is a sectional view showing an internal structure of an image forming apparatus according to an embodiment of the present disclosure.
Figure 2:
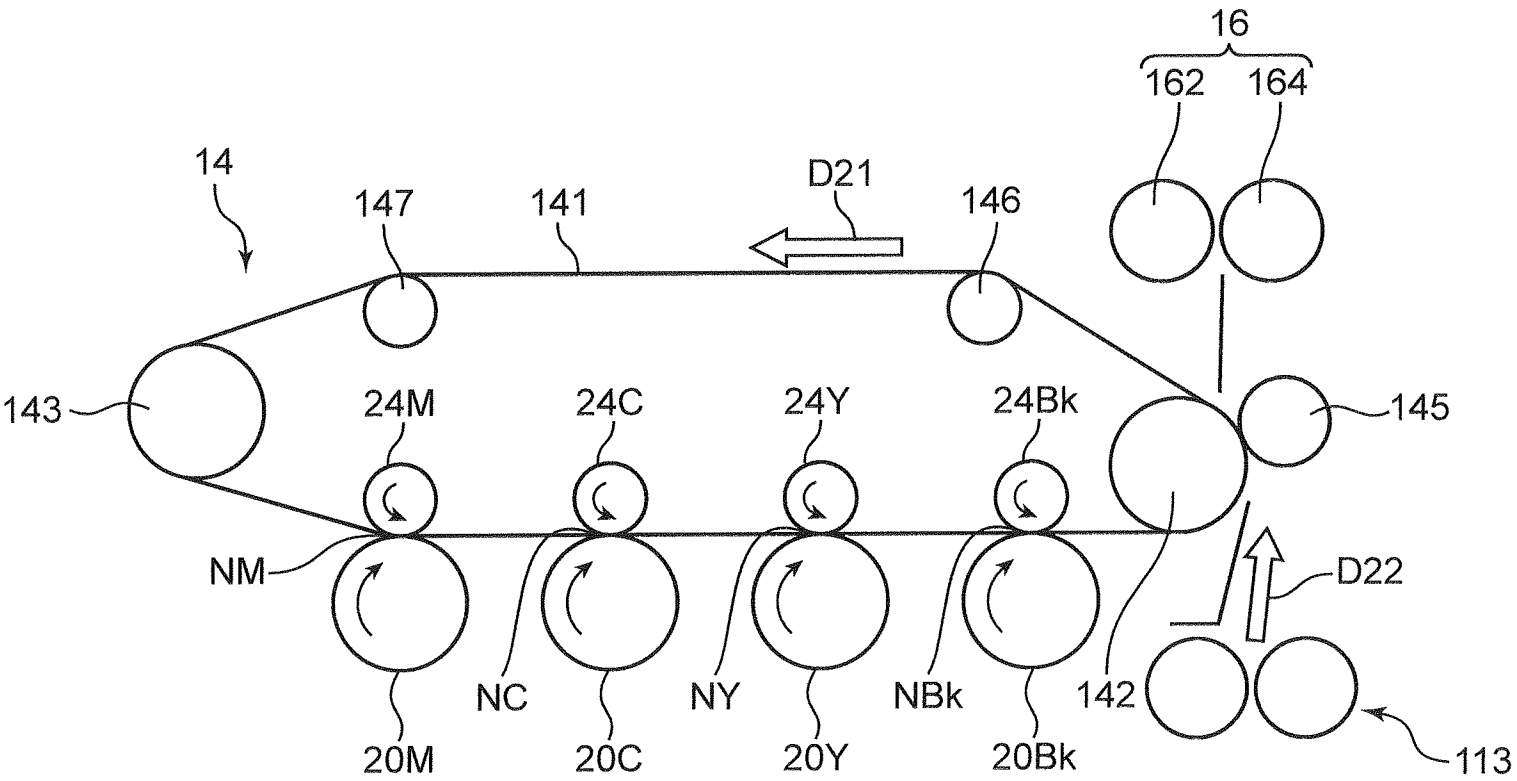
FIG. 2 is a schematic sectional view showing the periphery of an intermediate transfer unit according to the embodiment of the present disclosure.

FIG. 1 is a sectional view showing an internal structure of the image forming apparatus 10. FIG. 2 is a schematic sectional view showing the periphery of an intermediate transfer unit 14 in the image forming apparatus 10. This image forming apparatus 10 is provided with an apparatus main body 11 having a box-shaped housing structure. A sheet feeding unit 12 for feeding a sheet P, an image forming station 13 for forming a toner image to be transferred to the sheet P fed from the sheet feeding unit 12, an intermediate transfer unit 14 (transfer device) to which the toner image is primarily transferred, a toner supply unit 15 for supplying toner to the image forming station 13 and a fixing unit 16 for applying a process of fixing the unfixed toner image formed on the sheet P to the sheet P are housed in this apparatus main body 11. Further, a sheet discharge unit 17 to which the sheet P having the fixing process applied thereto in the fixing unit 16 is to be discharged is provided on the top of the apparatus main body 11.

An unillustrated operation panel operated to enter output conditions and the like for sheets P is provided at an appropriate position of the upper surface of the apparatus main body 11. This operation panel includes a power supply key, a touch panel used to enter output conditions, and various operation keys.

A vertically extending sheet conveyance path 111 is further formed to the right of the image forming station 13 in the apparatus main body 11. A pair of conveyor rollers 112 for conveying the sheet P are provided at an appropriate position in the sheet conveyance path 111. Further, a pair of registration rollers 113 for correcting the skew of the sheet P and feeding the sheet P to a secondary transfer nip portion to be described later at a predetermined timing are also provided upstream of the secondary transfer nip portion in the sheet conveyance path 111. The sheet conveyance path 111 is a conveyance path for conveying the sheet P from the sheet feeding unit 12 to the sheet discharge unit 17 by way of the image forming station 13 and the fixing unit 16.

The sheet feeding unit 12 includes a sheet feed tray 121, a pickup roller 122 and a pair of feed rollers 123. The sheet feed tray 121 is insertably and detachably mounted at a lower position of the apparatus main body 11 and stores a sheet stack P1 in which a plurality of sheets P are stacked. The pickup roller 122 picks up the uppermost sheet P of the sheet stack P1 stored in the sheet feeding unit 121 one by one. The pair of feed rollers 123 feed the sheet P picked up by the pickup roller 122 to the sheet conveyance path 111.

The sheet feeding unit 12 includes a manual sheet feeder mounted on the left side surface of the apparatus main body 11 shown in FIG. 1. The manual sheet feeder includes a manual feed tray 124, a pickup roller 125 and a pair of feed rollers 126. The manual feed tray 124 is a tray on which a sheet P to be manually fed is to be placed. In manually feeding the sheet P, the manual feed tray 124 is opened relative to the side surface of the apparatus main body 11 as shown in FIG. 1. The pickup roller 125 picks up the sheet P placed on the manual feed tray 124. The pair of feed rollers 126 feed the sheet P picked by the pickup roller 125 to the sheet conveyance path 111.

The image forming station 13 is for forming a toner image to be transferred to the sheet P and includes a plurality of image forming units for forming toner images of different colors. In this embodiment, a magenta unit 13M using magenta (M) developer, a cyan unit 13C using cyan (C) developer, a yellow unit 13Y using yellow (Y) developer and a black unit 13Bk using black (Bk) developer which are successively arranged from an upstream side to a downstream side (from left to right in FIG. 1) in a rotating direction of an intermediate transfer belt 141 to be described later are provided as the image forming units. Each of the units 13M, 13C, 13Y and 13Bk includes a photoconductive drum 20 (image bearing member) and a charging device 21, a developing device 23, a primary transfer roller 24 and a cleaning device 25 arranged around the photoconductive drum 20. Further, an exposure device 22 common to each of the units 13M, 13C, 13Y and 13Bk is arranged below the image forming units.

The photoconductive drum 20 rotates about its shaft and an electrostatic latent image and a toner image are formed on the circumferential surface thereof. A photoconductive drum using an amorphous silicon (a-Si) based material can be used as the photoconductive drum 20. Note that, as shown in FIG. 2, photoconductive drums 20M, 20C and 20Y and 20Bk are respectively arranged in correspondence with the image forming units of the respective colors. The charging device 21 uniformly charges the circumferential surface of the photoconductive drum 20. A charging device adopting a contact charging method and including a charging roller and a charged cleaning brush for removing toner adhering to the charging roller can be employed as the charging device 21. The exposure device 22 includes various optical components such as light sources, polygon mirrors, reflecting mirror and deflecting mirror and forms electrostatic latent images by irradiating light moderated based on image data to the uniformly charged circumferential surfaces of the photoconductive drums 20.

The developing device 23 supplies toner to the circumferential surface of the photoconductive drum 20 to develop an electrostatic latent image formed on the photoconductive drum 20. The developing device 23 is for two-component developer composed of toner and carrier and includes two agitating rollers 23A, a magnetic roller 23B and a developing roller 23C. The agitating rollers 23A charge the toner by conveying the two-component developer in a circulating manner while agitating it. A two-component developer layer is carried on the circumferential surface of the magnetic roller 23B and a toner layer formed by the transfer of the toner due to a potential difference between the magnetic roller 23B and the developing roller 23C is formed on the circumferential surface of the developing roller 23C. The toner on the developing roller 23C is supplied to the circumferential surface of the photoconductive drum 20 to develop the electrostatic latent image. Note that the toner has a property of being positively charged in this embodiment.

The primary transfer roller 24 forms a primary transfer nip portion N in cooperation with the photoconductive drum 20 by sandwiching the intermediate transfer belt 141 provided in the intermediate transfer unit 14. As shown in FIG. 2, primary transfer rollers 24M, 24C, 24Y and 24Bk are respectively arranged to face the photoconductive drums 20 of the respective colors. Primary transfer nip portions NM, NC, NY and NBk are formed between the respective photoconductive drums 20 and the primary transfer rollers 24. In this embodiment, the primary transfer rollers 24 are made of epichlorohydrin. Further, outer diameters of the primary transfer rollers 24 are 15 mm and resistance values thereof are 1E+6Ω in a state where a voltage of 1000V is applied. In this embodiment, a transfer bias having a polarity opposite to that of the toner is applied to the primary transfer roller 24 of each color by a constant current control during a transfer process by a bias applying unit 95 and a bias control unit 96 to be described later. Further, a transfer bias having the same polarity as that of the toner is applied to the primary transfer roller 24 of each color by a constant voltage control during a part of a non-transfer process different from the transfer process. Further, the cleaning device 25 cleans the circumferential surface of the photoconductive drum 20 after the transfer of the toner image.

The intermediate transfer unit 14 is arranged in a space provided between the image forming station 13 and the toner supply unit 15 and includes the intermediate transfer belt 141, a drive roller 142 and a driven roller 143 rotatably supported on an unillustrated unit frame. The intermediate transfer belt 141 is an endless belt-like rotating body and mounted on the drive roller 142 and the drive roller 143 such that the circumferential surface thereof is in contact with the circumferential surface of each photoconductive drum 20. A rotational drive force is applied to the drive roller 142 and the intermediate transfer belt 141 is driven to rotate by the rotation of the drive roller 142. In this embodiment, the drive roller 142 is formed of a tube internally provided with three linear parts circumferentially-spaced apart and radially extending from the center and made of aluminum. Specifically, an outer layer is coated with insulating alumite. The thickness of this outer layer is set to be 7 μm and a resistance value thereof is set to be 12.0 Log Ω·cm. A belt cleaning device 144 for removing the toner remaining on the circumferential surface of the intermediate transfer belt 141 is arranged near the driven roller 143. Although not shown in FIG. 1, driven rollers 146, 147 are further arranged at an upper surface part of the rotating intermediate transfer belt 141 as shown in FIG. 2. The driven rollers 146, 147 stretch the intermediate transfer belt 141. In this embodiment, the intermediate transfer belt 141 includes a layer made of an ion conductive material. Specifically, the intermediate transfer belt 141 includes the layer made of the ion conductive material containing Pvdf (polyvinylidene fluoride) and CR rubber (chloroprene rubber). In the ion conductive intermediate transfer belt 141, ions are transferred between polymer chains to provide electrical conductivity. Resistance unevenness per one belt is suppressed by such an ion conductive intermediate transfer belt 141.

A secondary transfer roller 145 (sheet transfer member) is arranged to face the drive roller 142. The secondary transfer roller 145 is pressed into contact with the circumferential surface of the intermediate transfer belt 141 to form a secondary transfer nip portion. Toner images primarily transferred to the intermediate transfer belt 141 are secondarily transferred to a sheet P supplied from the sheet feeding unit 12 in the secondary transfer nip portion. In this embodiment, the second transfer roller 145 is made of epichlorohydrin. Further, an outer diameter of the secondary transfer roller 145 is 20 mm and a resistance value thereof is 1E+7Ω in a state where a voltage of 1000V is applied.

The toner supply unit 15 is for storing the toners used for image formation and includes a magenta toner container 15M, a cyan toner container 15C, a yellow toner container 15Y and a black toner container 15Bk in this embodiment. These toner containers 15M, 15C, 15Y and 15Bk are for storing the toners of the respective colors of MCYBk to be supplied and supplies the toners of the respective colors to the developing devices 23 of the image forming units 13M, 13C, 13Y and 13Bk corresponding to the respective colors of MCYBk through toner discharge openings 15H formed on the bottom surfaces of the containers.

The fixing unit 16 includes a heating roller 161 with a heating source inside, a fixing roller 162 arranged to face the heating roller 161, a fixing belt 163 stretched between the fixing roller 162 and the heating roller 161, and a pressure roller 164 arranged to face the fixing roller 162 via the fixing belt 163, thereby forming a fixing nip portion. The sheet P fed to the fixing unit 16 is heated and pressed by passing through the fixing nip portion. In this way, the toner images transferred to the sheet P in the secondary transfer nip portion are fixed to the sheet P.

The sheet discharge unit 17 is formed by recessing a top part of the apparatus main body 11, and a sheet discharge tray 171 configured to receive the discharged sheet P is formed on a bottom part of this recess. The sheet P having a fixing process applied thereto is discharged toward the sheet discharge tray 171 by way of the sheet conveyance path 111 extending from an upper part of the fixing unit 16.

Figure 3:
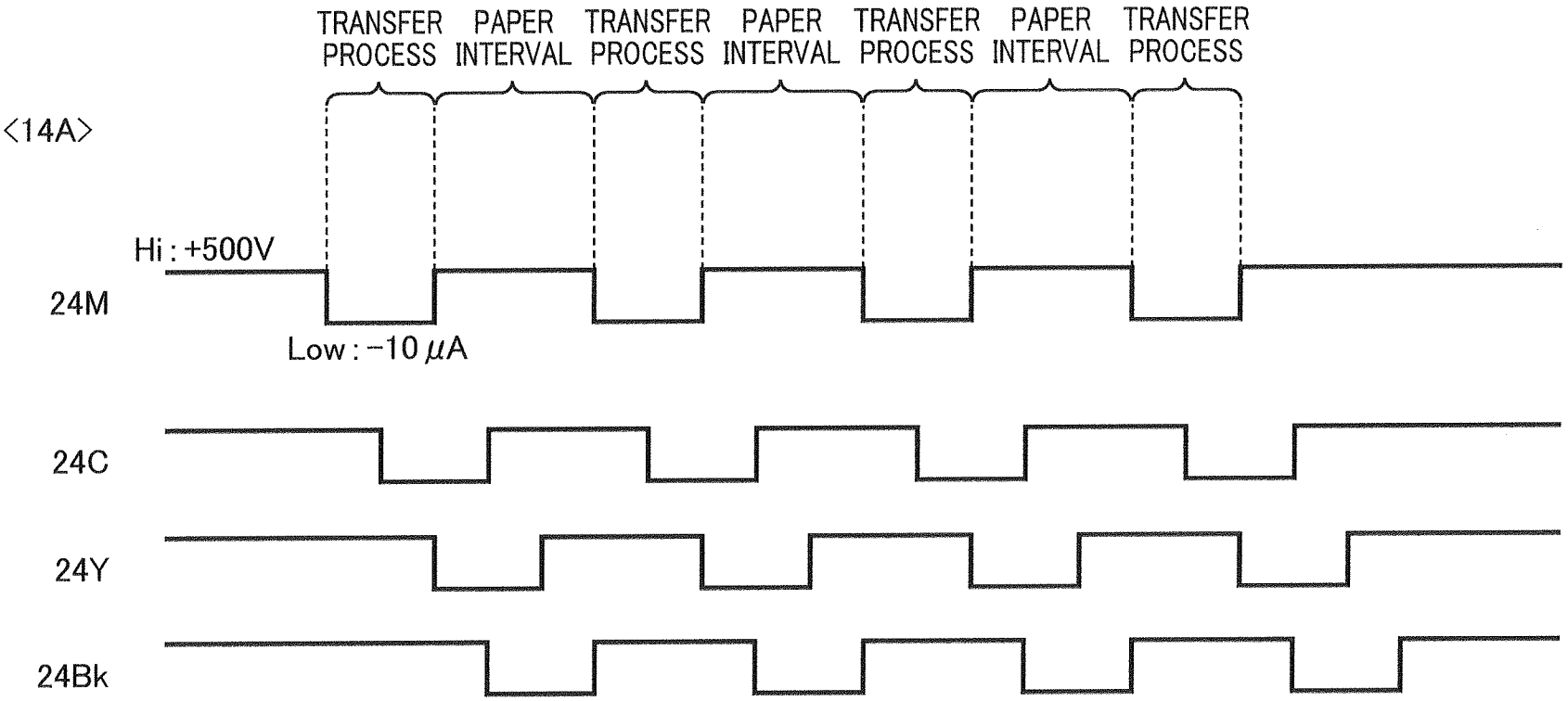
FIG. 3 is a timing chart showing another transfer bias control mode to be compared with the embodiment of the present disclosure.
Figure 4:
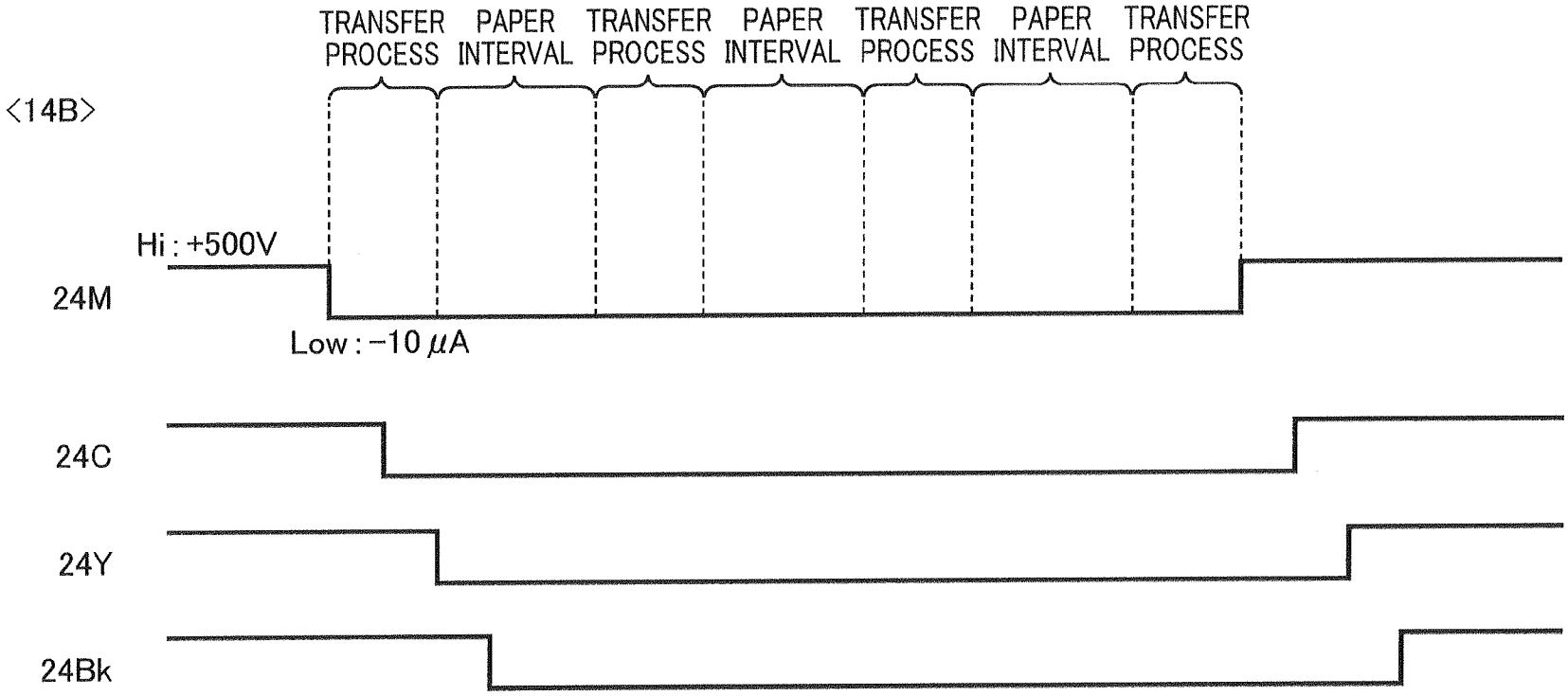
FIG. 4 is a timing chart showing another transfer bias control mode to be compared with the embodiment of the present disclosure.

Next, bias controls of other intermediate transfer units 14A, 14B to be compared with the intermediate transfer unit 14 according to this embodiment and troubles thereof are described. FIGS. 3 and 4 are timing charts when toner images are transferred onto the intermediate transfer belt 141 from the photoconductive drums 20 of the respective colors in the intermediate transfer units 14A, 14B. Timings at which a transfer voltage is applied to the primary transfer roller 24 of each color are shown in both FIGS. 3 and 4. With reference to FIG. 3, in the intermediate transfer belt 14A, a transfer bias having a polarity opposite to that of the toner is applied to the primary transfer roller 24 during a transfer process in which a toner image is transferred from the photoconductive drum 20 to the intermediate transfer belt 141. Specifically, a transfer current of −10 μA is caused to flow into the primary transfer roller 24 by a constant current control. On the other hand, during a paper interval in forming toner images on the intermediate transfer belt 141 for a plurality of sheets, a transfer bias having the same polarity as that of the toner is applied to the primary transfer roller 24. Specifically, a transfer voltage of +500V is applied to the primary transfer roller 24 by a constant voltage control. Then, as shown in FIG. 3, the transfer processes are successively performed in the primary transfer nip portions of the respective colors as the intermediate transfer belt 41 rotates. As a result, the toner images of the respective colors are transferred onto the intermediate transfer belt 141 in a superimposed manner. As just described, in the intermediate transfer unit 14A shown in FIG. 3, electric fields are formed in different directions along a thickness direction of the intermediate transfer belt 141 during the transfer process and during the paper interval. Thus, ions are unlikely to stay on one side in the thickness direction in the intermediate transfer belt 141 and a resistance increase of the intermediate transfer belt 141 is suppressed.

Figure 5:
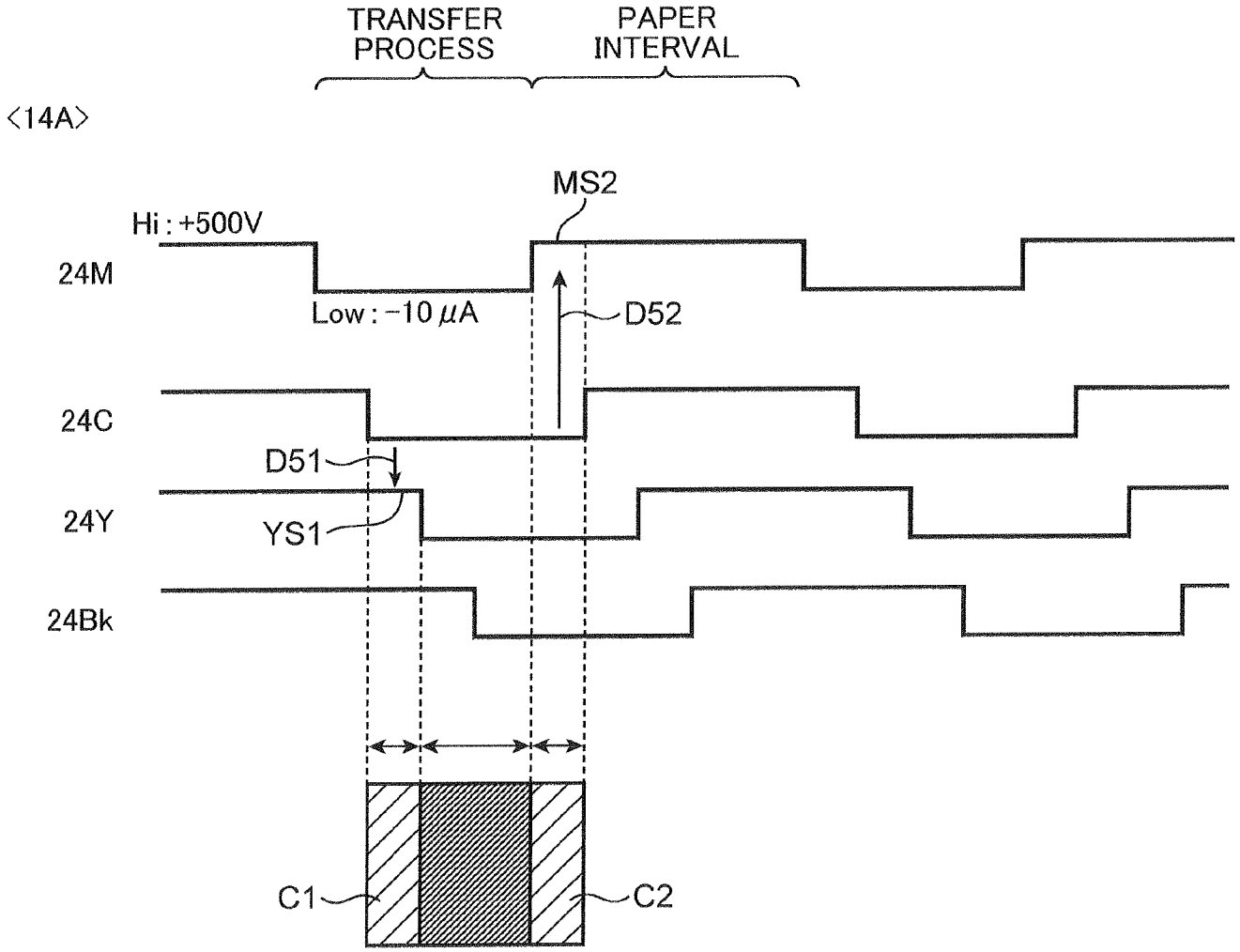
FIG. 5 is a chart showing a trouble which occurs in the control mode of FIG. 3.

On the other hand, in the intermediate transfer unit 14A shown in FIG. 3, the transfer currents tend to interfere between adjacent ones of the primary transfer nip portions. FIG. 5 is a timing chart enlargedly showing a part of FIG. 3 to explain the interference of the transfer currents. In FIG. 5, in the cyan primary transfer nip portion, the toner image transferred onto the intermediate transfer belt 141 is diagrammatically shown below the timing chart when viewed in a direction perpendicular to a belt surface of the intermediate transfer belt 141. As described above, in the primary transfer nip portion of each color of the intermediate transfer unit 14A, the transfer bias having the same polarity as that of the toner is applied to the primary transfer roller 24 during the paper interval. Specifically, while a leading end part C1 of the cyan toner image is transferred in FIG. 5, the transfer bias having the same polarity as that of the toner is applied to the adjacent yellow primary transfer roller 24Y (YS1 of FIG. 5). Thus, a part of the transfer current of −10 μA flowing into the cyan primary transfer roller 24C to form the leading end part C1 flows as a leakage current toward the yellow primary transfer roller 24Y set at a relatively high potential (arrow D51 of FIG. 5). As a result, the toner image of the leading end part C1 is not sufficiently transferred to cause a density reduction of the toner image on the intermediate transfer belt 141.

Similarly, when a trailing end part C2 of the cyan toner image is transferred, the transfer bias having the same polarity as that of the toner is applied to the adjacent magenta primary transfer roller 24M (MS2 of FIG. 5). Thus, a part of the transfer current of −10 μA flowing into the cyan primary transfer roller 24C to form the trailing end part C2 flows as a leakage current toward the magenta primary transfer roller 24M set at a relatively high potential (arrow D52 of FIG. 5). As a result, the toner image of the trailing end part C2 is not sufficiently transferred to cause a density reduction of the toner image on the intermediate transfer belt 141. As just described, in the bias control employed in the intermediate transfer unit 14A, the interference of the transfer current (leakage current) tends to occur when the transfer process and the paper interval are concurrently present in adjacent two primary transfer nip portions.

Next, the bias control of the intermediate transfer unit 14B to be compared with the intermediate transfer unit 14 according to this embodiment is described with reference to FIG. 4. The intermediate transfer unit 14B differs from the intermediate transfer unit 14A in that a transfer bias having a polarity opposite to that of the toner is applied to the primary transfer roller 24 of each color also during the paper interval as during the transfer process. Specifically, in the case of successively forming images on a plurality of sheets, the transfer bias having a polarity different from that of the toner continues to be applied to the primary transfer roller 24 of each color. In this case, the interference of the transfer current as described above does not occur. However, as the intermediate transfer belt 141 is used for a long period of time, ions tend to stay on one side in the thickness direction of the intermediate transfer belt 141 due to the transfer bias. As a result, the resistance value of the intermediate transfer belt 141 increases and image defects such as secondary transfer failures occur due to the charge-up of the intermediate transfer belt 141 and an increase in the electrification of the toner images carried on the belt.

Figure 6:
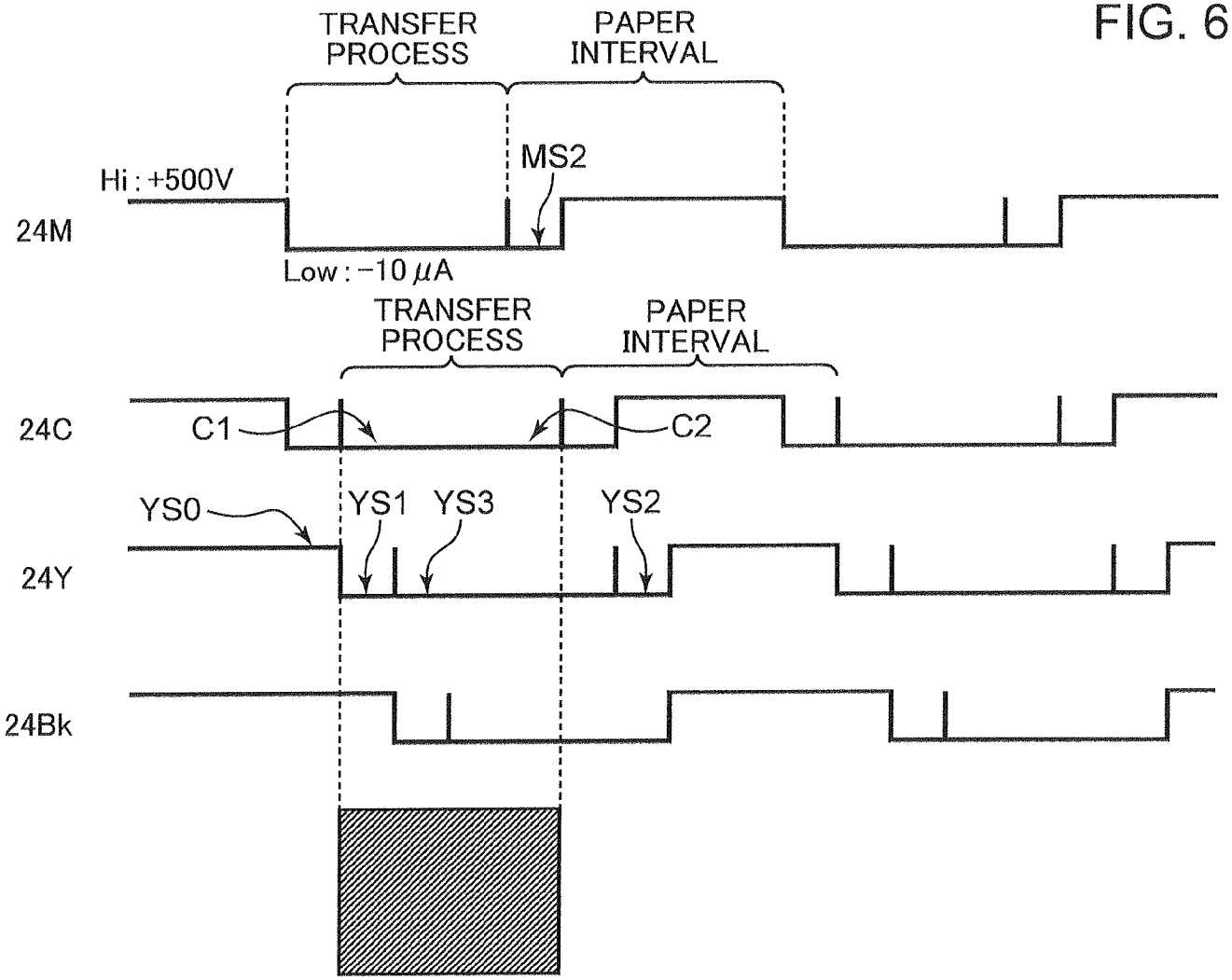
FIG. 6 is a timing chart showing a transfer bias control mode according to the embodiment of the present disclosure.
Figure 7:
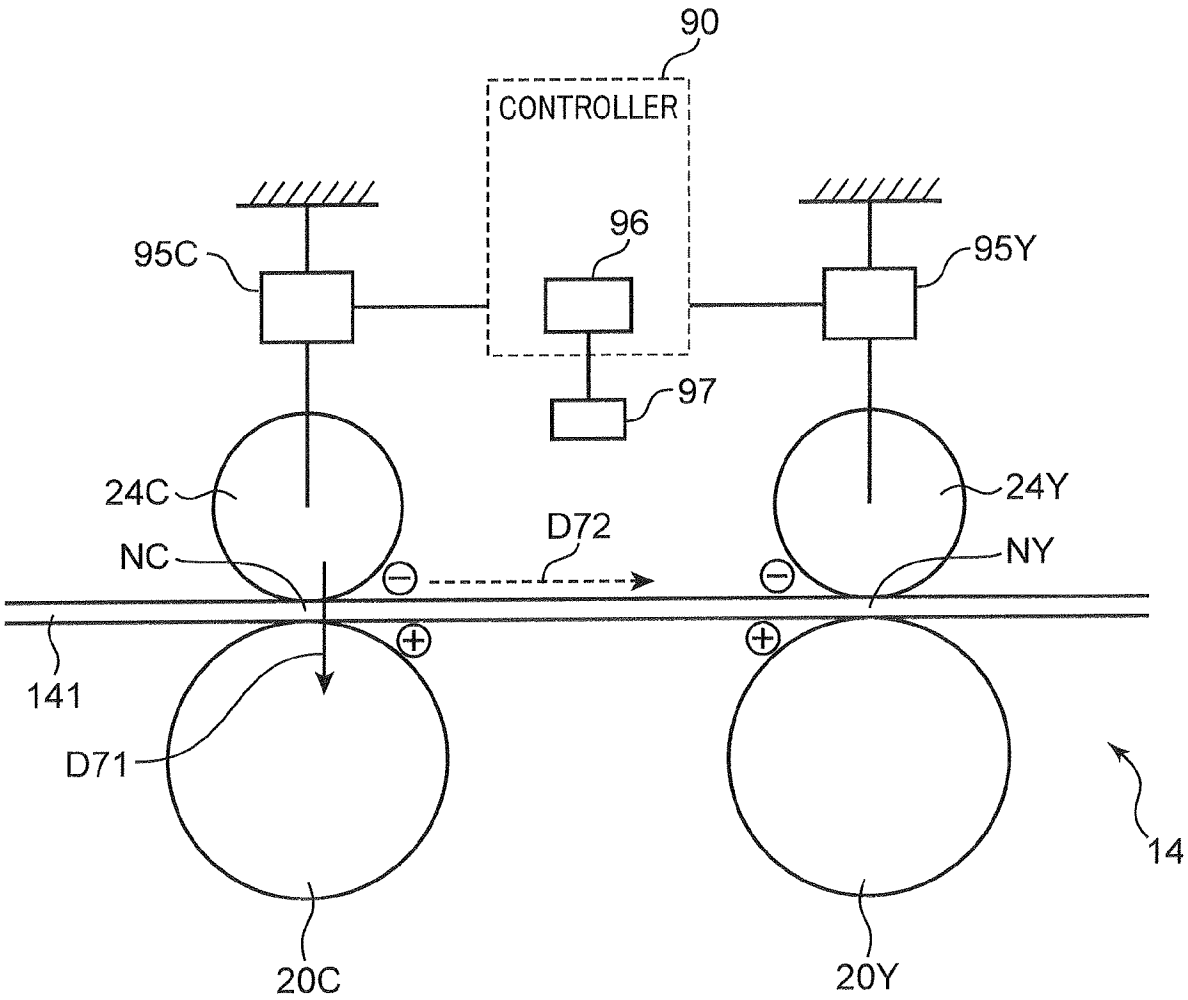
FIG. 7 is an electrical block diagram showing the periphery of primary transfer members according to the embodiment of the present disclosure.
Figure 8:
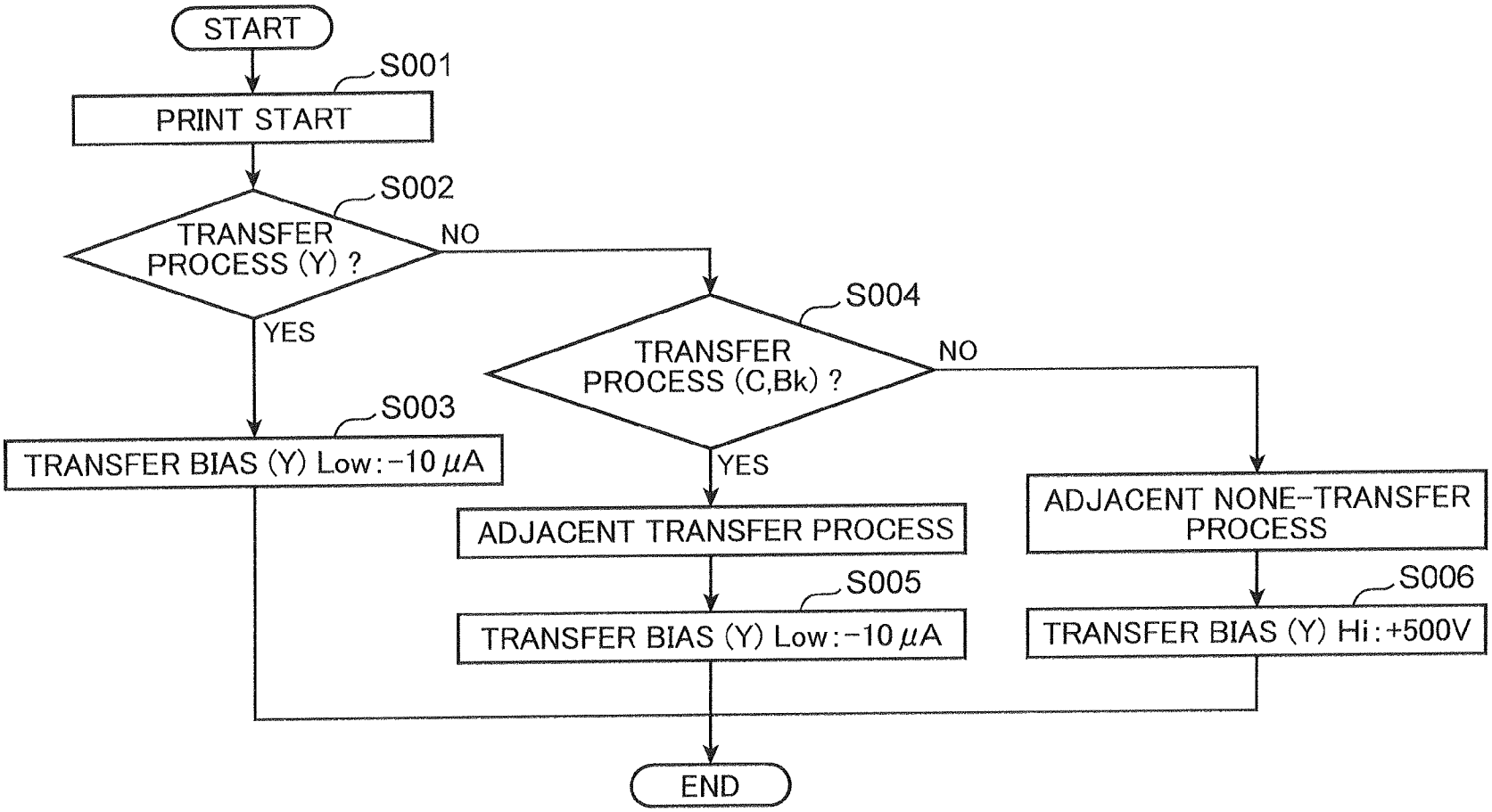
FIG. 8 is a flow chart showing the transfer bias control mode according to the embodiment of the present disclosure.

To solve the problems in the intermediate transfer units 14A, 14B as described above, the bias control unit 96 preferably controls the polarity of the transfer bias applied to the primary transfer roller 24 of each color in this embodiment. FIG. 6 is a timing chart of a transfer bias applied to the primary transfer roller 24 of each color by the bias control unit 96 in the intermediate transfer unit 14 according to this embodiment. FIG. 7 is a schematic and electrical block diagram enlargedly showing the periphery of the cyan and yellow primary transfer rollers 24C, 24Y out of the intermediate transfer unit 14. FIG. 8 is a flow chart of a bias control according to this embodiment.

With reference to FIG. 7, the intermediate transfer unit 14 includes the bias applying units 95C, 95Y, a controller 90 and an environmental sensor 97. The bias applying units 95C, 95Y are respectively electrically connected to the primary transfer rollers 24C, 24Y. The bias applying units 95C, 95Y respectively apply transfer biases to the primary transfer rollers 24C, 24Y. Note that similar bias applying units are connected also to the primary transfer rollers for the other colors. By the above transfer bias, a transfer electric field is formed between the primary transfer roller 24 and the photoconductive drum 20 and a toner image is transferred from the circumferential surface of the photoconductive drum 20 to the surface of the intermediate transfer belt 141. The environmental sensor 97 is provided in the apparatus main body 11 of the image forming apparatus 10 to detect ambient temperature and humidity. Temperature data and humidity data detected by the environmental sensor 97 are referred to by the bias control unit 96 and whether or not to control the transfer bias during a paper interval is judged.

The controller 90 is composed of a CPU (Central Processing Unit), a ROM (Read Only Memory) storing a control program, a RAM (Random Access Memory) used as a work area of the CPU and the like. Further, the environmental sensor 97 is electrically connected to the controller 90 in addition to the aforementioned bias applying units 95C, 95Y. The controller 90 functions to include the bias control unit 96 by the CPU executing the control program stored in the ROM. As described later, the bias control unit 96 controls the transfer biases applied to the primary transfer rollers 24C, 24Y by controlling the bias applying units 95C, 95Y.

With reference to FIG. 6, in this embodiment, a transfer bias having a polarity opposite to that of the toner is temporarily applied not only during a transfer process, but also during a non-transfer process represented by a paper interval. In FIG. 6, in this embodiment, when a transfer process for cyan (C) to the first sheet is started, i.e. at a timing corresponding to a leading end part C1 of FIG. 6, a transfer bias having a polarity opposite to that of the toner is applied to the adjacent yellow primary transfer roller 24Y (YS1 of FIG. 6). Thus, as shown by an arrow D71 of FIG. 7, a transfer current stably flows from the primary transfer roller 24C to the photoconductive drum 20C. In other words, the leakage of a part of the transfer current having flowed into the primary transfer roller 24C toward the primary transfer roller 24Y (primary transfer nip portion NY) via the intermediate transfer belt 141 as shown by an arrow D72 of FIG. 7 is suppressed. This is because the primary transfer roller 24Y is held at a potential having the same polarity as the primary transfer roller 24C.

Similarly, in FIG. 6, also when the transfer process for cyan (C) to the first sheet is finished, i.e. at a timing corresponding to the trailing end part C2 of FIG. 5 described above, the transfer bias having a polarity opposite to that of the toner is applied to the adjacent magenta primary transfer roller 24M (MS2 of FIG. 6). Thus, the leakage of a part of the transfer current having flowed into the primary transfer roller 24C toward the primary transfer roller 24M (primary transfer nip portion NM) via the intermediate transfer belt 141 is suppressed.

Next, a flow of controlling the transfer bias applied to the yellow primary transfer roller 24Y by the bias control unit 96 is described in detail for the above bias control. In FIG. 8, when a printing operation is started (Step S001), the bias control unit 96 judges whether or not the transfer process should be executed at the current timing in the yellow primary transfer nip portion NY (Step S002). In the case of the timing for the execution of the transfer process for yellow (YES in Step S002), the bias control unit 96 applies a transfer bias having a polarity opposite to that of the toner to the primary transfer roller 24Y by controlling the bias applying unit 95Y (Step S003, YS3 in FIG. 6). Specifically, the bias control unit 96 causes a transfer current of −10 μA to flow into the primary transfer roller 24Y by a constant current control.

On the other hand, if the transfer process for yellow should not be executed at the current timing in Step S002 (NO in Step S002), the bias control unit 96 judges whether or not the transfer process should be executed at the current timing in the cyan or black primary transfer nip portion NC or NBk adjacent to the one for yellow (Step S004). In the case of the timing for the execution of the transfer process in the cyan or black primary transfer nip portion NC or NBk (YES in Step S004), the bias control unit 96 applies the above transfer bias having a polarity opposite to that of the toner to the primary transfer roller 24Y as an adjacent transfer process (Step S005, YS1, YS2 in FIG. 6).

On the other hand, if the transfer process should not be executed in the cyan or black primary transfer nip portion NC or NBk at the current timing (NO in Step S004), the bias control unit 96 applies a transfer bias having the same polarity as that of the toner to the primary transfer roller 24Y as an adjacent non-transfer process (Step S006, YS0 in FIG. 6). Specifically, the bias control unit 96 applies a transfer bias of +500V to the primary transfer roller 24Y by a constant voltage control. At this time, a current of about +2 μA is caused to flow into the primary transfer roller 24Y as a transfer current. As a result, an electric field in a direction opposite to the one formed during the transfer process is formed in the intermediate transfer belt 141. Thus, it is suppressed that ions stay on one side in the thickness direction of the intermediate transfer belt 141 and the resistance value of the intermediate transfer belt 141 increases.

A transfer bias control similar to the above is executed for each primary transfer roller 24 (24M, 24C, 24Y, 24Bk). Note that the bias control unit 96 may execute the above control in response to a specific environment. As described above, in this embodiment, the intermediate transfer belt 141 is made of the ion conductive material. In such a material, its resistance value may be reduced by one digit in a high-temperature and high-humidity environment. In this case, the interference (leakage current) of the transfer current as described above tends to become notable. Accordingly, the bias control unit 96 may apply a transfer bias having a polarity opposite to that of the toner to the primary transfer roller 24 during the adjacent transfer process (Step S005 of FIG. 8), for example, if an environment in which temperature is not lower than 28° C. and relative humidity is not lower than 80% is detected by the environmental sensor 97. In this case, in the high-temperature and high-humidity environment where the resistance value of the intermediate transfer belt 141 tends to increase, the flow of the transfer current from the primary transfer nip portion N, in which the transfer process is ongoing, to another primary transfer nip portion N via the intermediate transfer belt 141 is suppressed.

As described above, according to the above embodiment, a toner image is, for example, transferred from the photoconductive drum 20Y to the intermediate transfer belt 141 by the application of a transfer bias having a polarity opposite to that of the toner to the primary transfer roller 24Y (first transfer member) during a transfer process in the yellow primary transfer nip portion NY (first transfer nip). Further, an electric field in a direction opposite to the one during the transfer process is formed in the intermediate transfer belt 141 by the application of a transfer bias having the same polarity as that of the toner to the primary transfer roller 24Y during an adjacent non-transfer process which is a non-transfer process in the primary transfer nip portion NY and a non-transfer process also in the adjacent cyan or black primary transfer nip portion NC or NBk (second transfer nip). As a result, a resistance increase of the intermediate transfer belt 141 is suppressed. Further, the flow of a transfer current from the primary transfer nip portion NC or NBk, in which a transfer process is ongoing, to the primary transfer nip portion NY via the intermediate transfer belt 141 is suppressed by the application of a transfer bias having a polarity opposite to that of the toner to the primary transfer roller 24Y during an adjacent transfer process which is a non-transfer process in the primary transfer nip portion NY and a transfer process in the primary transfer nip portion NC or NBk.

Further, according to the above embodiment, in the intermediate transfer belt 141 made of the ion conductive material provided with electrical conductivity due to the transfer of ions between polymer chains, it is preferably suppressed that ions stay on one side in the thickness direction of the intermediate transfer belt 141 to induce an increase in the resistance value.

Further, according to the above embodiment, as compared with the case where the transfer bias having a polarity opposite to that of the toner continues to be applied not only during the transfer process, but also during the paper interval, a long-term increase in the resistance value of the intermediate transfer belt 141 is preferably suppressed. Further, it is suppressed that the density of the toner image transferred to the intermediate transfer belt 141 is partly reduced due to the interference of the transfer current. In other words, image defects caused by the charge-up of the intermediate transfer belt 141 and an increase in the electrification of the toner image are prevented.

Furthermore, even if the primary transfer nip portion NY corresponds to the paper interval, the transfer process can be executed in the primary transfer nip portion NC or NBk while the leakage of the transfer current is suppressed. Thus, as compared with the case where the transfer process and the non-transfer process are executed in synchronization in the adjacent primary transfer nip portions, the paper interval can be set narrower. In other words, to constantly concurrently execute the transfer process and the non-transfer process in the adjacent primary transfer nip portions, the paper interval needs to be set wider, which reduces the productivity of the printing operation.

Although one embodiment of the present disclosure has been described in detail above, the present disclosure is not limited to this. The present disclosure can be, for example, embodied as follows.

(1) Although the toner is positively charged in the above embodiment, the present disclosure is not limited to this. Even if the toner is negatively charged, the interference of the transfer current is preferably suppressed by the application of the transfer bias having a polarity opposite to that of the toner to the primary transfer roller 24 during the adjacent transfer process.

(2) Further, the use of the above environmental sensor 97 is not limited to the detection of temperature or humidity around the intermediate transfer belt 141 in the image forming apparatus. In another embodiment, an environmental sensor may detect the temperature or humidity of a surrounding environment where the image forming apparatus 10 is installed.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A transfer device, comprising:

a plurality of image bearing members each driven and rotated and configured to bear a toner image made of toner which is charged to a predetermined polarity;

an intermediate transfer belt arranged to face the plurality of image bearing members and driven and rotated to transfer the toner images from the plurality of image bearing members to a surface thereof in a superimposed manner;

a plurality of transfer members configured to form a plurality of transfer nips in cooperation with the plurality of image bearing members by sandwiching the intermediate transfer belt and configured to cause the toner images to be transferred from the image bearing members to the intermediate transfer belt;

a transfer bias applying unit configured to apply a transfer bias to the transfer member during a transfer process in which the toner image is transferred from the image bearing member to the intermediate transfer belt and a non-transfer process different from the transfer process; and a bias control unit configured to cause a transfer bias having a polarity opposite to that of the toner to be applied to a first transfer member, out of the plurality of transfer members, configured to form a first transfer nip out of the plurality of transfer nips during the transfer process in the first transfer nip and during an adjacent transfer process which is the non-transfer process in the first transfer nip and the transfer process in a second transfer nip adjacent to the first transfer nip and causing a transfer bias having the same polarity as that of the toner to be applied to the first transfer member during an adjacent non-transfer process which is the non-transfer process in the first transfer nip and the non-transfer process in the second transfer nip.

2. A transfer device according to claim 1, further comprising:

an environmental sensor configured to detect temperature or humidity around the intermediate transfer belt;

wherein the bias control unit causes a transfer bias having a polarity opposite to that of the toner to be applied to the first transfer member during the adjacent transfer process if the temperature or humidity detected by the environmental sensor exceeds a threshold value set in advance.

3. A transfer device according to claim 2, wherein:

the intermediate transfer belt includes a layer made of an ion conductive material.

4. A transfer device according to claim 3, wherein:

the ion conductive material contains polyvinylidene fluoride and chloroprene rubber.

5. A transfer device according to claim 1, wherein:

the intermediate transfer belt includes a layer made of an ion conductive material.

6. A transfer device according to claim 5, wherein:

the ion conductive material contains polyvinylidene fluoride and chloroprene rubber.

7. A transfer device according to claim 1, wherein:

the bias control unit causes a transfer bias having a polarity opposite to that of the toner to be applied to the first transfer member by a constant current control and causes a transfer bias having the same polarity as that of the toner to be applied to the first transfer member by a constant voltage control.

8. An image forming apparatus, comprising:

a transfer device including an intermediate transfer belt; and a sheet transfer member configured to transfer a toner image from the intermediate transfer belt to a sheet;

wherein the transfer device includes:

a plurality of image bearing members each driven and rotated and configured to bear a toner image made of toner which is charged to a predetermined polarity;

the intermediate transfer belt arranged to face the plurality of image bearing members and driven and rotated to transfer the toner images from the plurality of image bearing members to a surface thereof in a superimposed manner;

a plurality of transfer members configured to form a plurality of transfer nips in cooperation with the plurality of image bearing members by sandwiching the intermediate transfer belt and configured to cause the toner images to be transferred from the image bearing members to the intermediate transfer belt;

a transfer bias applying unit configured to apply a transfer bias to the transfer member during a transfer process in which the toner image is transferred from the image bearing member to the intermediate transfer belt and a non-transfer process different from the transfer process; and a bias control unit configured to cause a transfer bias having a polarity opposite to that of the toner to be applied to a first transfer member, out of the plurality of transfer members, configured to form a first transfer nip out of the plurality of transfer nips during the transfer process in the first transfer nip and during an adjacent transfer process which is the non-transfer process in the first transfer nip and the transfer process in a second transfer nip adjacent to the first transfer nip and causing a transfer bias having the same polarity as that of the toner to be applied to the first transfer member during an adjacent non-transfer process which is the non-transfer process in the first transfer nip and the non-transfer process in the second transfer nip.

9. An image forming apparatus according to claim 8, further comprising:

an environmental sensor configured to detect temperature or humidity around the intermediate transfer belt;

wherein the bias control unit causes a transfer bias having a polarity opposite to that of the toner to be applied to the first transfer member during the adjacent transfer process if the temperature or humidity detected by the environmental sensor exceeds a threshold value set in advance.

10. An image forming apparatus according to claim 9, wherein:

the intermediate transfer belt includes a layer made of an ion conductive material.

11. An image forming apparatus according to claim 10, wherein:

the ion conductive material contains polyvinylidene fluoride and chloroprene rubber.

12. An image forming apparatus according to claim 8, wherein:

the intermediate transfer belt includes a layer made of an ion conductive material.

13. An image forming apparatus according to claim 12, wherein:

the ion conductive material contains polyvinylidene fluoride and chloroprene rubber.

14. An image forming apparatus according to claim 8, wherein:

the bias control unit causes a transfer bias having a polarity opposite to that of the toner to be applied to the first transfer member by a constant current control and causes a transfer bias having the same polarity as that of the toner to be applied to the first transfer member by a constant voltage control.

15. An image forming apparatus according to claim 8, wherein:

the non-transfer process is executed during an interval between one sheet and subsequent another sheet in the case of successively transferring the toner images to a plurality of sheets.

* * * * *